US007486027B2

(12) United States Patent
Lee et al.

(10) Patent No.: US 7,486,027 B2
(45) Date of Patent: Feb. 3, 2009

(54) ORGANIC LIGHT EMITTING DIODE DISPLAY DEVICE

(75) Inventors: Chang Hwan Lee, Gyeongsangbuk-Do (KR); Hoon Ju Chung, Gyeonggi-Do (KR)

(73) Assignee: LG Display Co., Ltd., Seoul (KR)

( * ) Notice: Subject to any disclaimer, the term of this patent is extended or adjusted under 35 U.S.C. 154(b) by 664 days.

(21) Appl. No.: 11/239,003

(22) Filed: Sep. 30, 2005

(65) Prior Publication Data

US 2006/0066255 A1 Mar. 30, 2006

(30) Foreign Application Priority Data

Sep. 30, 2004 (KR) ..... 10-2004-0078046

(51) Int. Cl.
*G05G 3/10* (2006.01)
*G09G 3/30* (2006.01)

(52) U.S. Cl. ..... 315/169.1; 315/169.3; 345/76

(58) Field of Classification Search ..... 315/169.1, 315/169.2, 169.3, 291; 345/30, 33, 36, 39, 345/76, 84, 55, 77, 204
See application file for complete search history.

(56) References Cited

U.S. PATENT DOCUMENTS 6,191,779 B1 * 2/2001 Taguchi et al. ..... 345/204
7,184,065 B2 * 2/2007 Shin ..... 345/690
2004/0056204 A1 * 3/2004 Tanaka et al. ..... 250/370.09
2004/0178980 A1 * 9/2004 Rao et al. ..... 345/96

FOREIGN PATENT DOCUMENTS

| | | |
|---|---|---|
| CN | 1435810 | 8/2003 |
| CN | 1484212 | 3/2004 |
| WO | WO 2004-025614 | 3/2004 |

* cited by examiner

*Primary Examiner*—Douglas W. Owens
*Assistant Examiner*—Minh Dieu A
(74) *Attorney, Agent, or Firm*—McKenna Long & Aldridge LLP

(57) ABSTRACT

An organic light emitting diode display device comprising a display panel, a plurality of light emitting diodes arranged on the display panel and having an optical amount varied according to a current amount, a sample/hold unit for supplying a current to the light emitting diodes, a D/A converter for controlling a current amount supplied to the light emitting diodes from the sample/hold unit by controlling a current amount supplied from the sample/hold unit according to image information, and a voltage controller for conducting or shielding a current between the D/A converter and the sample/hold unit by outputting a second bias voltage of which loss voltage has been compensated according to a characteristic of a transistor provided at the D/A converter to the D/A converter by receiving a first bias voltage.

21 Claims, 4 Drawing Sheets

ORGANIC LIGHT EMITTING DIODE DISPLAY DEVICE

This application claims the benefit of Korean Patent Application No. 2004-078046, filed on Sep. 30, 2004, which is hereby incorporated by reference for all purposes as if fully set forth herein.

BACKGROUND OF THE INVENTION

1. Field of the Invention

The present invention relates to an organic light emitting diode (OLED) display device, and more particularly, to an OLED display device having a high image quality.

2. Discussion of the Related Art

Generally, cathode ray tubes (CRT), one of display devices being widely used, are mainly used as monitors for televisions, measuring devices, information terminal devices, etc. However, due to CRT's weight and size, there is a limitation in minimizing the size and weight of these electronic products.

Recently, organic light emitting diode (OLED) display devices are being spotlighted as the next generation display device due to such advantages as high contrast ratio, high brightness, low consumption power, fast response time, wide viewing angle, lightweight, etc. The OLED display devices are also able to display various colors similar to natural colors and have a further advantage of a simple fabrication process. Thus, the OLED display devices are being widely used for mobile phones, personal digital assistants, computers, televisions, etc.

When a voltage driving method is adopted to drive the OLED display devices, the brightness of the OLED display devices is not uniform and it is difficult to display correct color images due to a sensitivity difference among R, G, and B colors. Therefore, a current driving method is mainly used to drive the OLED display devices.

FIG. 1 is a view illustrating an OLED display device according to the related art.

Referring to FIG. 1, the OLED display device includes a pixel array unit 115 having a plurality of pixels, a sample/hold unit 132 for supplying a current to the pixel array unit 115 to drive light emitting diodes provided in each pixel, and a digital/analogue (D/A) converter 134 for controlling an amount of the current supplied to the pixel array unit 115 from the sample/hold unit 132 in accordance with image data.

The pixel array unit 115 is provided with a plurality of transistors and light emitting devices (DD1). The light emitting device DD1 emits light by the current supplied from the sample/hold unit 132 via a transistor operated by a scan signal SS1. The light emitting device DD1 is generally a light emitting diode.

A power voltage source VDD is applied to the sample/holder unit 132, so that currents flow to the pixel array unit 115 and the D/A converter 134. An amount of the current introduced into the pixel array unit 115 and an amount of the current introduced into the D/A converter 134 have a 1:N relationship. More specifically, because the sample/holder unit 132 has a current mirror circuit, 1/N of the amount of the current flown to the D/A converter 134 from the sample/hold unit 132 is supplied to the pixel array unit 115.

The D/A converter 134 is provided for displaying images with various gray levels. The D/A converter 134 controls an amount of the current supplied from the sample/holder unit 132 in accordance with digital image data supplied from an outside video source. The D/A converter 134A includes a plurality of switching devices. As the switching devices are individually turned on or off in accordance with the digital image data, an amount of the current supplied to the D/A converter 134 from the sample/hold unit 132 varies. An amount of the current supplied to the pixel array unit 115 from the sample/hold unit 132 varies according to the amount of the current supplied to the D/A converter 134.

FIG. 2 is a view illustrating a circuit construction of the D/A converter and sample/hold unit of FIG. 1.

Referring to FIG. 2, a D/A converter 234 includes a plurality of switching devices SW1 to SW6 that are turned on or off according to digital image data D0 to D5, and a plurality of sink devices SNK1 to SNK6.

The switching devices SW1 to SW6 are turned on or off according to the digital image data D0 to D5. That is, the switching devices SW1 to SW6 are matched one to one to each bit of the image data D0 to D5. Because each bit of the image data D0 to D5 has a different weight value, an amount of the current that passes through each of the switching devices SW1 to SW6 is different. To do so, each switching device SW1 to SW6 has a different channel size. For example, because a weight value of the image data D0 corresponding to the first switching device SW1 is greater than a weight value of the image data D5 corresponding to the sixth switching device SW6, an amount of the current applied to the first switching device SW1 is greater than an amount of the current applied to the sixth switching device SW6.

The sink devices SNK1 to SNK 6 are operated by a bias voltage Vbias to control amounts of the currents applied to the switching devices SW1 to SW6. More specifically, when the sink devices SNK1 to SNK6 are turned on, they perform a current sink function for grounding the currents introduced to the switching devices SW1 to SW6, and when the sink devices SNK1 to SNK6 are turned off, they shield the currents applied from a sample/hold unit 232. Thin film transistors can be used as the sink devices SNK1 to SNK6 and the switching devices SW1 to SW6.

The sample/hold unit 232 includes two first transistors MP1 and MP2, two second transistors MN1 and MN2, and one capacitor C1. Because the second transistors MN1 and MN2 are N-type transistors, they are turned on when a control signal CS1 of a high voltage is applied thereto. Also, because the first transistors MP1 and MP2 are P-type transistors, they are turned on when the control signal CS1 of a low voltage is applied thereto. Accordingly, when the control signal CS1 is a high voltage, a current flows from the power voltage source VDD to the D/A converter 234 via the first transistor MP1 and the second transistor MN2, and the corresponding current also flows to a pixel array unit 215. Because the first transistors MP1 and MP2 provided in the sample/hold unit 232 have different channel sizes, an amount of the current applied to the first transistor MP1 and an amount of the current applied to the first transistor MP2 have a 1:N relationship.

Recently, a research is being actively conducted to make OLED display devices lighter and thinner. Accordingly, a driving circuit is integrally formed with a display panel using poly-crystalline silicon thin film transistors to reduce the fabrication cost. A low temperature poly-crystalline silicon (LTPS) method is mainly used to form the poly-crystalline silicon thin film transistors in which amorphous silicon is crystallized by laser.

In the LTPS method, when laser is non-uniformly irradiated on amorphous silicon or a surface treatment prior to irradiating laser is not properly performed, the characteristics of the poly-crystalline silicon thin film transistors become non-uniform, which negatively influences on the image quality or life span. That is, due to the irregular laser energy irradiated on amorphous silicon, the channels of the thin film transistors formed by the LTPS method have various sizes and distributions of crystallites. Accordingly, the carrier mobility and threshold voltage of each thin film transistor become different. Because the characteristics of the thin film transistors are different, an amount of current flown to each thin film transistor becomes different even when the same bias voltage is applied to an OLED display panel. Although the characteristics of the thin film transistors in different driving blocks may be largely different, the characteristics of the adjacent thin film transistors in one driving block are generally similar.

Accordingly, amounts of the currents applied to the sink devices SNK1 to SNK6 of each driving block are different even when the same bias voltage is applied to the OLED display device. Thus, even when the same image data is applied to each driving block, the same image is not implemented, thereby degrading the image quality of the OLED display device.

SUMMARY OF THE INVENTION

Accordingly, the present invention is directed to an organic light emitting diode (OLED) display device that substantially obviates one or more of the problems due to limitations and disadvantages of the related art.

An advantage of the present invention is to provide an OLED display device having a high image quality by compensating different transistor characteristics.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described herein, an organic light emitting diode (OLED) display device includes a pixel array unit having a plurality of light emitting diodes; a sample/hold unit for supplying a first current to the pixel array unit to drive the light emitting diodes; a D/A converter for controlling an amount of the first current supplied to the pixel array unit in accordance with image data; and a voltage controller for controlling a second current flowing between the D/A converter and the sample/hold unit by outputting a bias voltage corresponding to a brightness of the pixel array unit.

In another aspect of the present invention, an organic light emitting diode display device includes a display panel; a plurality of light emitting diodes arranged on the display panel and emitting light, an amount of the light varying according to an amount of a first current supplied to the light emitting diodes; a sample/hold unit for supplying the current to the light emitting diodes; a D/A converter for controlling the amount of the current supplied to the light emitting diodes from the sample/hold unit according to image data; and a voltage controller for controlling a second current flowing between the D/A converter and the sample/hold unit by outputting a second bias voltage of which loss voltage has been compensated according to a characteristic of a transistor provided at the D/A converter to the D/A converter by receiving a first bias voltage.

In yet another aspect of the present invention, an organic light emitting diode (OLED) display device includes a pixel array unit having a plurality of pixels arranged in matrix configuration; a sample and hold unit including a current mirror circuit and connected to at least one of the pixels for providing a current to said pixel using the current mirror circuit; a digital/analogue (D/A) converter including a plurality of switching devices connected to the sample and hold unit and a plurality of sink transistors for controlling an amount of the current provided to said pixel in accordance with digital image data received from a video source; and a voltage controller connected to gate electrodes of the sink transistors of the D/A converter and outputting a voltage level modulated based on a threshold voltage characteristic of the sink transistors of the D/A converter.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which are illustrated in the accompanying drawings.

Figure 1:
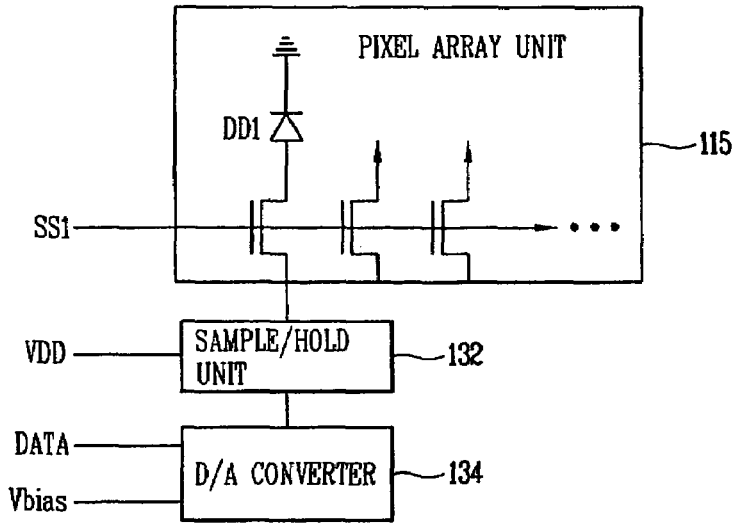
FIG. 1 RELATED ART
FIG. 1 is a view illustrating an organic light emitting diode (OLED) display device according to the related art.
Figure 2:
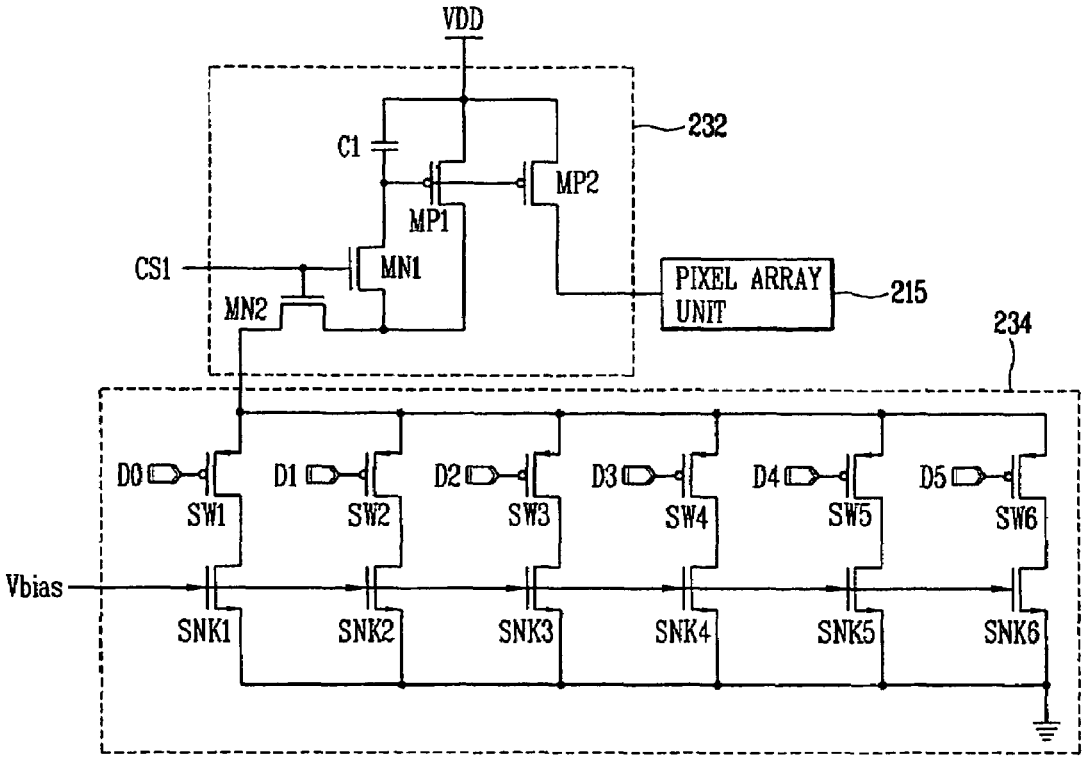
FIG. 2 RELATED ART
FIG. 2 is a view illustrating a circuit construction of the D/A converter and sample/hold unit of FIG. 1.
Figure 3:
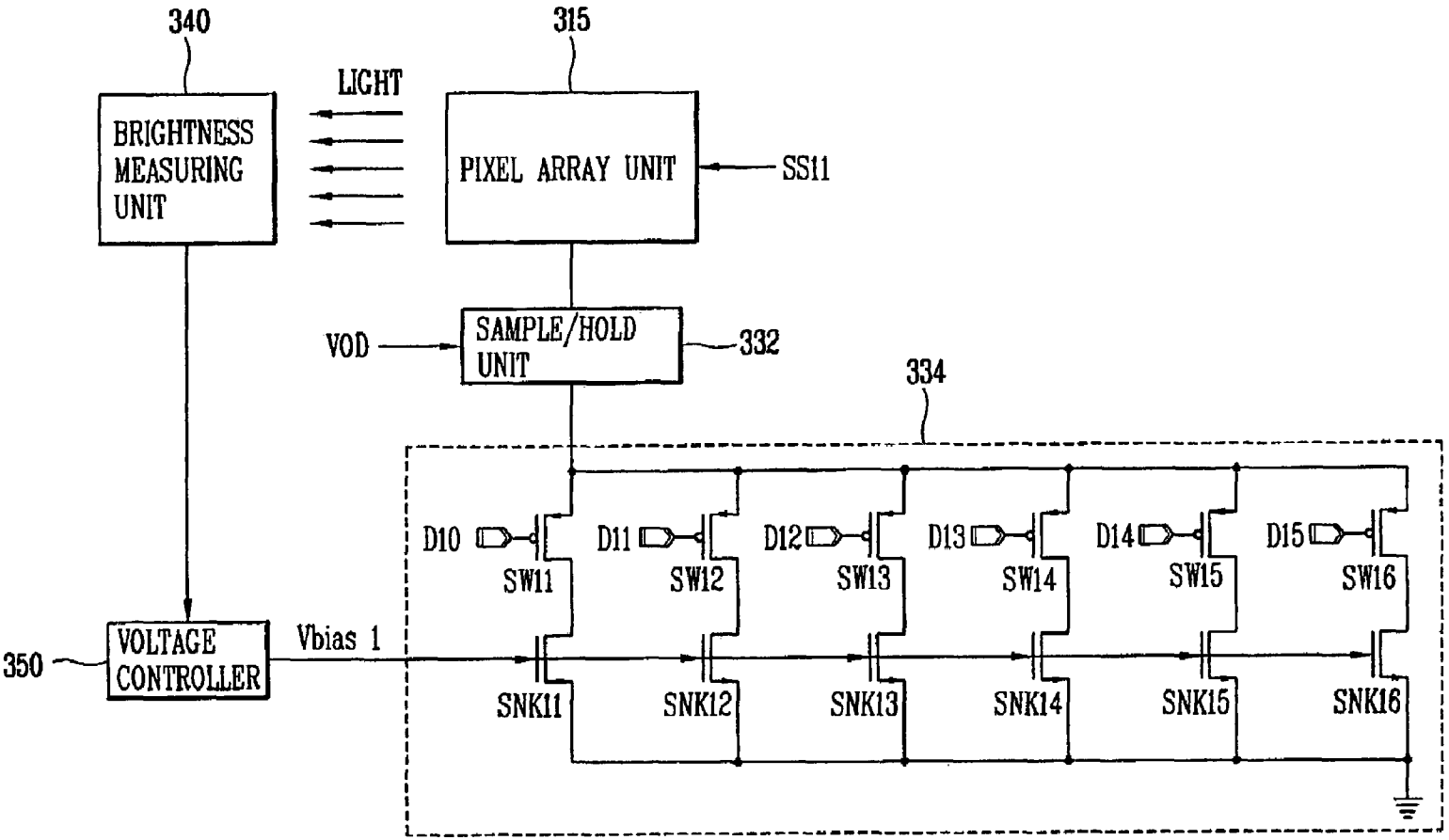
FIG. 3 is a view illustrating an OLED display device according to a first embodiment of the present invention.

FIG. 3 is a view illustrating an organic light emitting diode (OLED) display device according to a first embodiment of the present invention.

Referring to FIG. 3, the OLED display device comprises a pixel array unit 315 having a plurality of pixels arranged in a matrix form, a sample/hold unit 332 for supplying a current to the pixel array unit 315 to drive light emitting diodes of the pixel array unit 315, a D/A converter 334 for controlling an amount of the current supplied to the pixel array unit 315 from the sample/hold unit 332 in accordance with digital image data D10 to D15, and a voltage controller 350 for driving the D/A converter 334 by applying a voltage to the D/A converter 334 according to a brightness of the pixel array unit 315.

The pixel array unit 315 is provided with a plurality of pixels arranged in a matrix form. Although not shown in the drawings, each pixel is provided with at least one thin film transistor, a capacitor and a light emitting diode. The light emitting diode provided in each pixel emits a different amount of light depending on an amount of the current supplied from the sample/hold unit 332.

The D/A converter 334 controls an amount of the current supplied from the sample/hold unit 332 to the pixel array unit 315. The D/A converter 334 includes a plurality of switching devices SW11 to SW16 connected respectively to a plurality of sink devices SNK11 to SNK16. The D/A converter 334 illustrated in FIG. 3 has six switching devices SW11 to SW16 and six sink devices SNK11 to SNK16 to display images in accordance with 6-bit image data. Because the switching devices SW11 to SW16 provided in the D/A converter 334 are individually turned on or off in order to control an amount of the current supplied from the sample/hold unit 332, various amounts of current can be flown to the D/A converter 334 by variously combining the switching devices SW11 to SW16.

The switching devices SW11 to SW16 provided in the D/A converter 334 are turned on or turned off according to each bit value of the image data. However, because each bit of the image data has a different weight value, a different amount of current is flown to each switching device SW11 to SW16 corresponding to one of the six bits. For example, an amount of the current flown to the first switching device SW11 controlled by the uppermost bit HSB of the 6-bit image data is greater than an amount of the current flown to the sixth switching device SW16 controlled by the lowest bit LSB.

The sink devices SNK11 to SNK16 provided in the D/A converter 334 are used for grounding the currents introduced to the switching devices SW11 to SW16. Therefore, the sink devices SNK11 to SNK16 are simultaneously turned on or off.

The sample/hold unit 332 includes a current mirror circuit. The sample/hold unit 332 has two transistors having different channel sizes so that amounts of the currents flown to the two transistors have a ratio relationship with each other. An amount of the current supplied to the D/A converter 334 from the sample/hold unit 332 is controlled by variously combining the switching devices SW11 to SW16 using the current mirror, thereby controlling an amount of the current supplied to the pixel array unit 315 from the sample/hold unit 332. A brightness of the light emitting diode is dependent on an amount of the current supplied to the pixel array unit 315.

In the first embodiment of the present invention, a bias voltage Vbias11 having a controlled voltage level is applied to the D/A converter 334 according to a brightness of the display panel to control an amount of the current supplied from the sample/hold unit 332 to be grounded.

To do so, an average brightness of the image displayed on the pixel array unit 315 is measured. Then, the measured brightness is inputted to the voltage controller 350. The voltage controller 350 may include a variable resistance and a look-up table therein. The voltage controller 350 has a reference voltage and increases or decreases the reference voltage using the variable resistance according to the average brightness of the display panel measured by the brightness measuring unit, thereby outputting a bias voltage Vbias11. Because the look-up table stores a plurality of bias voltage values corresponding to average brightness, a bias voltage Vbias11 corresponding to an inputted average brightness of the display panel is selected.

Because each driving block of the display panel has a different average brightness, the voltage controller 350 outputs a different bias voltage Vbias 11 to each driving block to equalize the average brightness of each driving block. That is, even when each driving block has a different device characteristic of the sink devices SNK11 to SNK16, a voltage compensation is performed by providing different bias voltages Vbias11 to the driving blocks of the display panel. Accordingly, when the same image data are provided, the same image with the same brightness can be displayed.

Figure 4A:
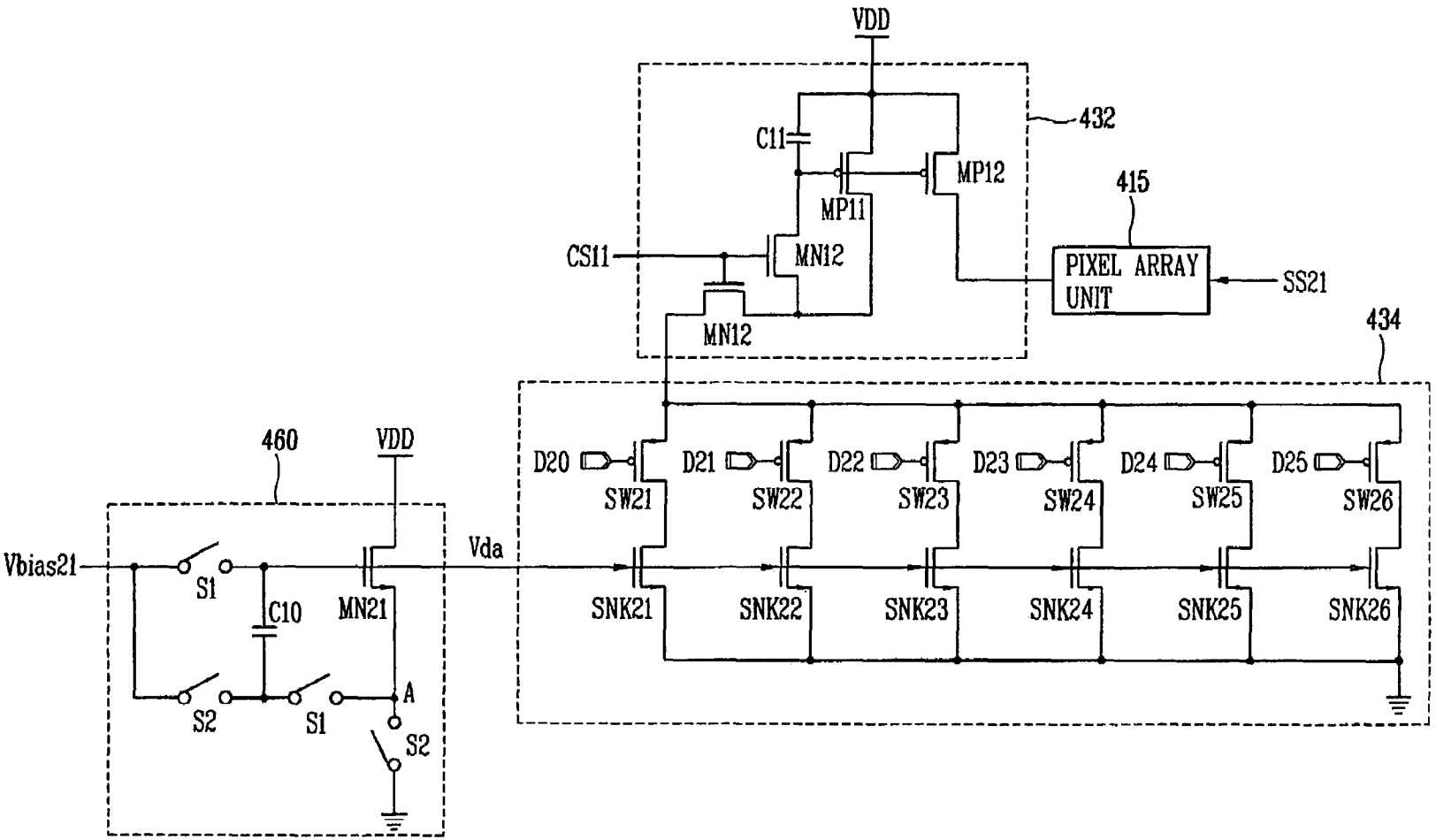
FIG. 4A is a view illustrating an OLED display device according to a second embodiment of the present invention.
Figure 4B:
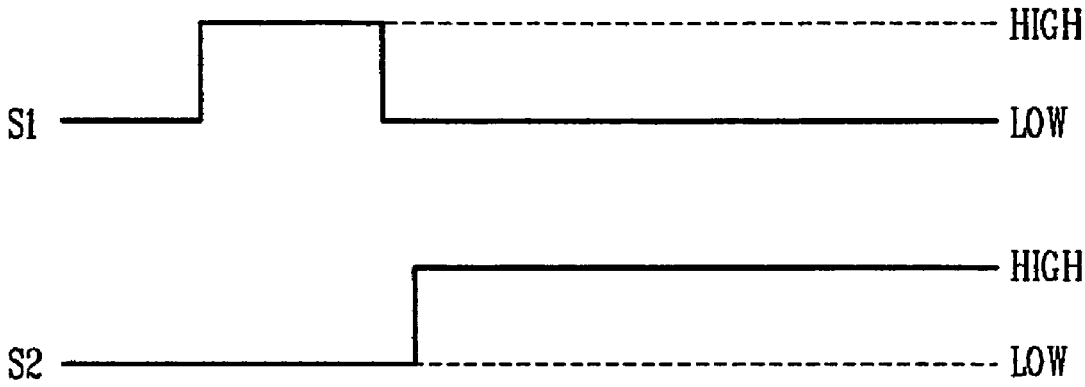
FIG. 4B is a view illustrating a timing chart for first and second switches of the voltage controller of FIG. 4A.

FIG. 4A is a view illustrating an organic light emitting diode (OLED) display device according to a second embodiment of the present invention, and FIG. 4B is a view illustrating a timing chart for first and second switches of the voltage controller of FIG. 4A.

Referring to FIG. 4, the OLED display device includes a pixel array unit 415 having a plurality of light emitting diodes (not shown) for displaying an image, a sample/hold unit 432 for supplying a current to the pixel array unit 415 to drive the light emitting diodes, a D/A converter 434 for controlling an amount of the current supplied to the pixel array unit 415 from the sample/hold unit 432 in accordance with digital image data, and a voltage controller 460 for driving the D/A converter 434 by applying a bias voltage Vbias21 to the D/A converter according to a device characteristic of the D/A converter 434.

The pixel array unit 415 includes a plurality of pixels defined by crossings of a plurality of vertical data lines and a plurality of horizontal gate lines. The pixels are arranged in the pixel array unit 415 in a matrix form, and each pixel is provided with at least one thin film transistor, a capacitor and a light emitting diode. The pixel array unit 415 is provided in a display panel, and the light emitting diode in each pixel emits light by a current supplied from the sample/hold unit 432 through the data lines. An amount of light emitted from the light emitting diode is dependent on an amount of the current supplied from the sample/hold unit 432. An organic light emitting diode (OLED) is used as the light emitting diode.

The sample/hold unit 432 includes first transistors MN11 and MN12 to be turned on or off by a control signal CS11 for stopping or passing a current supplied to the D/A converter 434 from the power voltage source VDD, second transistors MP11 and MP12 for applying a predetermined amount of current to the pixel array unit 415, which has a ratio relationship with an amount of the current outputted to the D/A converter 434, when the first transistors MN11 and MN12 are turned on, and a capacitor C11 for charging a constant voltage when the first transistors MN11 and MN12 are turned on and maintaining the amount of the current to be supplied to the pixel array unit 415 even when the first transistors MN11 and MN12 are turned off.

The first transistors MN11 and MN12 are N-type transistors, and are turned on when the control signal CS11 of a high voltage is applied thereto so that a current flows from the power voltage source VDD to the D/A converter 434 through the second transistor MP11 and the first transistors MN11 and MN12. The second transistors MP11 and MP12 are P-type transistors and turned on by the control signal CS11 of a low voltage to flow a current.

When a current flows to the D/A converter 434 from the sample/hold unit 432 by the control signal CS11, a charge corresponding to a voltage difference between the power voltage source VDD and a gate electrode of the second transistor MP11 is charged to the capacitor C11. Accordingly, even when the first transistors MN11 and MN12 are turned off as the control signal CS11 is transited into a lower voltage, the second transistors MP11 and MP12 are turned on by the voltage charged in the capacitor C11, thereby maintaining the current to be supplied to the pixel array unit 415.

The two second transistors MP11 and MP12 perform a current mirror function. Because the second transistors MP11 and MP12 have different channel sizes, amounts of the currents flown to the second transistor MP11 and MP12 are different from each other. Therefore, a 1/N amount of the current flown to the D/A converter 434 is supplied to the pixel array unit 415. The channel size indicates a width of a gate channel divided by a length of a gate channel (width/length: W/L).

As descried above, an amount of the current supplied to the pixel array unit 415 from the sample/hold unit 432 and an amount of light emitted from the light emitting diode are controlled by controlling an amount of the current flown to the D/A converter 434 from the sample/hold unit 432.

The D/A converter 434 includes a plurality of switching devices SW21 to SW26 to be turned on or off by image data for controlling an amount of the current supplied from the sample/hold unit 432, and a plurality of sink devices SNK21 to SNK26 for turning on or off currents flown to the switching devices SW21 to SW26. The switching devices SW21 to SW26 are turned on or off in correspondence to each bit value of the image data. The amounts of the currents flown to the switching device SW21 to SW26 are different from one another, because the switching devices SW21 to SW26 have different channel sizes.

The sink devices SNK21 to SNK26 are respectively connected to the switching devices SW21 to SW26. All the sink devices SNK21 to SNK26 are simultaneously turned on by the bias voltage Vbias21 outputted from the voltage controller 460 so that a current flows from the sample/hold unit 432 to the D/A converter 434. Thin film transistors may be used as the switching devices SW21 to SW26 and the sink devices SNK21 to SNK26.

The voltage controller 460 compensates different threshold voltages of the sink devices SNK21 to SNK26 formed in the driving blocks of the display panel to minimize or prevent non-uniform brightness on the display panel.

The voltage controller 460 according to the second embodiment includes two first switches S1, two second switches S2, a third transistor MN21 and a capacitor C10. The first switches S1 and the second switches S2 are simultaneously opened or closed. The capacitor C10 is connected between the first switches S1. One side of the capacitor C10 is connected to the first switch S1, and the other side of the capacitor C10 is connected to a gate electrode of the third transistor MN21. The third transistor MN21 is formed at the same time when the sink devices SNK21 to SNK26 of the D/A converter 434 are formed at a position near to the sink devices SNK21 to SNK26. Thus, the third transistor MN21 has almost the same characteristics including the threshold voltage as those of the sink device SNK21 to SNK2. Accordingly, the threshold voltages of the sink devices SNK21 to SNK26 in different driving blocks can be compensated.

The operation of the voltage controller 460 will now be explained. When the first switch S1 is closed, the third transistor MN21 is turned on by the bias voltage Vbias21. At the same time, the first switch S1, the third transistor MN21 and the capacitor C10 form a closed loop circuit. The threshold voltage of the third transistor MN21 is stored in the capacitor C10. When the first switch S1 is opened and the second switch S2 is closed, the bias voltage Vbias21 applied to the voltage controller 460 and the threshold voltage of the third transistor MN21 stored in the capacitor C10 are added to each other thereby to be applied to the sink devices SNK21 to SNK26.

As described above, because the threshold voltage of the third transistor MN21 is the same as that of each sink device, the voltage controller 460 can output a bias voltage Vda for compensating the threshold voltages of sink devices in different driving blocks.

FIG. 4B is a view illustrating a timing chart for the first switch S1 and the second switch S2.

Referring to FIG. 4B, a signal having a high voltage is applied to the first switch S1 to close the first switch S1. The threshold voltage of the third transistor MN21 is stored in the capacitor C10. After the capacitor C10 is charged, the signal of a high voltage applied to the first switch S1 is transited into a signal of a low voltage and the signal of a high voltage is applied to the second switch S2 to close the second switch S2.

The compensation bias voltage Vda equal to the sum of the threshold voltage of the third transistor MN21 charged to the capacitor C10 and the bias voltage Vbias21 is outputted to the gate electrode of each sink device SNK21 to SNK26. That is, the voltage controller 460 outputs the compensation bias voltage Vda for compensating the threshold voltages of the sink devices SNK21 to SNK26 by sequentially opening and closing the first switch S1 and the second switch S2.

In the OLED display devices according to the present invention, different threshold voltages of driving transistors in different driving blocks are compensated to minimize or prevent non-uniform brightness on the display panel.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An organic light emitting diode (OLED) display device, comprising:

a pixel array unit having a plurality of light emitting diodes;

a sample/hold unit for supplying a first current to the pixel array unit to drive the light emitting diodes;

a D/A converter for controlling an amount of the first current supplied to the pixel array unit in accordance with image data; and a voltage controller for controlling a second current flowing between the D/A converter and the sample/hold unit by outputting a bias voltage corresponding to a brightness of the pixel array unit.

2. The device of claim 1, wherein the voltage controller receives a reference voltage, and increases or decreases the reference voltage according to the brightness of the pixel array unit.

3. The device of claim 2, wherein the voltage controller has at least one variable resistance for varying a level of the reference voltage.

4. The device of claim 1, wherein the voltage controller has a look-up table for storing a plurality of bias voltages to be selectively outputted according to the brightness of the pixel array unit.

5. The device of claim 1, wherein the voltage controller is controlled according to bit values of the image data to control an amount of the second current supplied from the sample/hold unit.

6. An organic light emitting diode display device, comprising:

a display panel;

a plurality of light emitting diodes arranged on the display panel and emitting light, an amount of the light varying according to an amount of a first current supplied to the light emitting diodes;

a sample/hold unit for supplying the current to the light emitting diodes;

a D/A converter for controlling the amount of the current supplied to the light emitting diodes from the sample/hold unit according to image data; and a voltage controller for controlling a second current flowing between the D/A converter and the sample/hold unit by outputting a second bias voltage of which loss voltage has been compensated according to a characteristic of a transistor provided at the D/A converter to the D/A converter by receiving a first bias voltage.

7. The device of claim 6, wherein the loss voltage is a threshold voltage of the transistor.

8. The device of claim 6, wherein the D/A converter comprises:

a plurality of switching devices individually conducted or shielded according to image information for determining a current amount supplied from the sample/hold unit by a combination thereof; and a plurality of sink devices connected to a ground and conducted by the second bias voltage applied from the voltage controller, for conducting or shielding a current between the sample/hold unit and the D/A converter.

9. The device of claim 8, wherein the switching devices have different channel sizes.

10. The device of claim 8, wherein the switching devices and the sink devices are transistors.

11. The device of claim 8, wherein the switching devices are conducted or shielded according to each bit value of the image information.

12. The device of claim 8, wherein the sink devices are simultaneously conducted or shielded by the second bias voltage.

13. The device of claim 6, wherein the sample/hold unit comprises:

a plurality of first transistors for conducting or shielding a current to be outputted to the D/A converter according to a control signal; and a plurality of second transistors for supplying a current amount having a constant ratio with a current amount outputted to the D/A converter to the light emitting diodes.

14. The device of claim 6, wherein the voltage controller comprises:

a plurality of first switches and second switches sequentially opened and closed;

a voltage compensating device having the same threshold voltage as that of a transistor of the D/A converter; and a capacitor for storing the threshold voltage of the voltage compensating device while the first switches are closed, and for adding the stored threshold voltage of the voltage compensating device to the first bias voltage and thereby outputting to the second bias voltage while the second switches are closed.

15. The device of claim 14, wherein the transistor is a sink device for controlling a current flow between the sample/hold unit and the D/A converter by the voltage controller.

16. An organic light emitting diode (OLED) display device comprising:

a pixel array unit having a plurality of pixels arranged in matrix configuration;

a sample and hold unit including a current mirror circuit and connected to at least one of the pixels for providing a current to said pixel using the current mirror circuit;

a digital/analogue (D/A) converter including a plurality of switching devices connected to the sample and hold unit and a plurality of sink transistors for controlling an amount of the current provided to said pixel in accordance with digital image data received from a video source; and a voltage controller connected to gate electrodes of the sink transistors of the D/A converter and outputting a voltage level modulated based on a threshold voltage characteristic of the sink transistors of the D/A converter.

17. The device according to claim 16, wherein the voltage level is modulated by measuring a brightness of the corresponding portion of the pixel array unit.

18. The device according to claim 17, wherein the voltage controller includes a look-up table storing voltage levels corresponding to a plurality of brightness levels.

19. The device according to claim 16, wherein the voltage controller includes a measuring transistor formed near the sink transistors of the D/A converter.

20. The device according to claim 19, wherein a threshold voltage of the measuring transistor is substantially the same as threshold voltages of the sink transistors of the D/A converter.

21. The device according to claim 19, wherein the modulated voltage level is a sum of a reference voltage level and a threshold voltage of the measuring transistor.

* * * * *